United States Patent [19]

Hamilton

[11] 4,301,639

[45] Nov. 24, 1981

[54] APPARATUS AND METHOD FOR PRODUCING A CONTAINER FOR FOOD AND THE LIKE

[76] Inventor: Joel A. Hamilton, 101 Hardenburgh Ave., Demarest, N.J. 07627

[21] Appl. No.: 80,685

[22] Filed: Oct. 1, 1979

Related U.S. Application Data

[63] Continuation-in-part of Ser. No. 19,462, Mar. 9, 1979, abandoned.

[51] Int. Cl.[3] ..... B65B 9/04; B65B 1/02

[52] U.S. Cl. ..... 53/456; 53/558; 53/574

[58] Field of Search ..... 53/456, 450, 553, 555, 53/452, 462, 463, 558, 574

[56] References Cited

U.S. PATENT DOCUMENTS

| | | | |
|---|---|---|---|
| 2,091,126 | 8/1937 | Speer | 53/456 X |
| 3,300,944 | 1/1967 | Thesing | 53/552 X |
| 3,345,795 | 10/1967 | Anderson | 53/452 X |
| 3,726,058 | 4/1973 | Stark | 53/456 |
| 3,797,197 | 3/1974 | Fluck | 53/456 X |

*Primary Examiner*—Horace M. Culver
*Attorney, Agent, or Firm*—Ralph R. Roberts

[57] ABSTRACT

There is shown apparatus and method for producing a container preferably made or constructed of heat sealable material. Shaping of the container is by forming and not heat stretching or other distortion. In the depicted examples of the container the travelling strip is formed with a midwidth transverse cut leaving on and at each edge a carrier strip. The formed container is preferably filled with a product and then a cover to retain the product is brought to this container and heat sealed in place by the apparatus. After this filling and sealing, the package is further severed at the prior transverse cut to make separate packages.

21 Claims, 17 Drawing Figures

140
16
16a
136
138
128
124
126
88
86
80
82
84
127
123
15
14
122
120
90
92
132
134
131

APPARATUS AND METHOD FOR PRODUCING A CONTAINER FOR FOOD AND THE LIKE

REFERENCE TO RELATED APPLICATION

The application filed herewith includes the showing and description of my application Ser. No. 019,462 as filed Mar. 9, 1979 and includes a further embodiment to show an improvement recently developed. This enclosed application is a continuation-in-part of my application Ser. No. 019,462 now abandoned.

BACKGROUND OF THE INVENTION

1. Field of the Invention

With reference to the classification of art as established by and in the United States Patent and Trademark Office this invention is believed to be in the general Class entitled, "Package Making" (Class 53) and in the subclass entitled, "receptacle formed and subsequently filled" (subclass 456) and/or the subclass entitled, "forming or partially forming receptacles and subsequent filling" (subclass 574).

2. Description of the Prior Art

Packages for food products are well known. In particular, packages of processed and/or mixed products ready for opening, serving and/or immediately using are very widely used. Foods served on airliners, such as jellies and the like, are such packaged products. Fast food outlets provide individual servings of condiments such as ketchup, mustard, salad dressing mixtures and the like. In such packaged products it is customary to employ a heat forming of the pocket or recess in the bottom or component receiving strip of the package. After forming and filling the pocket in this strip with the product, a cover member is usually sealed in place around the flat planer surface to retain the product in place. This cover usually has the same or equal barrier properties as the carrier strip. After forming, filling and sealing by affixing a cover, the completed package is usually cut apart into separate packages.

Patent disclosures directed to the above package making or to the making or filling of bags are shown in part by U.S. Pat. No. 2,749,817 to Piazze et al., as issued on June 12, 1956; U.S. Pat. No. 3,667,354 to Steinmetz as issued on June 6, 1972; U.S. Pat. No. 3,762,617 to Matthis as issued on Oct. 2, 1973; U.S. Pat. No. 3,813,998 to Lotto as issued on June 4, 1974; U.S. Pat. No. 3,884,129 to Monahan as issued on May 20, 1975 and my U.S. Pat. No. 4,048,782 as issued on Sept. 20, 1977. Foreign patents are represented by British Pat. No. 1,075,540 as filed on Nov. 9, 1964.

In these and other known art the pocket is usually formed in at least the bottom carrier strip by heat or the carrier strip is otherwise stretched. Other box forming means include blanks cut, creased and then folded to provide a receptacle. Cover means is then applied to retain the product.

In the present invention it is anticipated that a lower strip is advanced to a transverse cutting means whereat the strip is cut midway to leave edge carrier portions on both sides of the strip. This advancement of the strip may be continuous or intermittent. This strip, usually a bottom strip, may be a foil, paper, a laminate or any strip material being capable of retaining its shape once it has been formed and providing a satisfactory wrapper for the particular material to be packaged. After a transverse cut in at least the bottom strip has been made, the strip is troughed by appropriately shaped dies, rollers or fingers as and with the side portions moved toward each other. The central portion of this strip is bent transversely to form a stop or end. This formed pocket is filled with the product to be packaged and then a cover is sealed in place. The resulting packaged product is then preferably cut into separate units. The cover member is also troughed in certain instances before applying to the bottom member.

SUMMARY OF THE INVENTION

This invention may be summarized, at least in part, by reference to its objects.

It is an object of this invention to provide, and it does provide, packaging apparatus wherein at least the carrier strip is formed into a pocket or pouch without stretching or heat shaping. The ends of the formed pocket or pouch are adjacent to transverse cuts made in the carrier web or strip. These end portions are bent transversely of the strip to provide a dam or stop for the product to be packaged. The cover is sealed in place to the side and the end planer portions of the lower carrier to provide a sealed package which may provide a hermetic seal of the product to be packaged. After forming and sealing the package, the carrier strip is further severed to provide individual packages of the product.

It is a further object of this invention to provide, and it does provide, a pocket or pouch formed in a travelling strip which may be of foil, paper, a laminate or the like. This pocket or pouch is formed by a shaping mandrel without the benefit of heat forming. This pouch or pocket is formed in foil, paper, laminated strip or film which is shaped by manipulative means rather than stretching or heat forming of the pocket. A transverse cut is formed in the travelling strip with the sides as carrier edges left intact so that the strip is not completely severed. Near these transverse cuts the strip is formed into end stops. These stops, by folding, shaping or by known displacing means provide a pocket or pouch in this strip. After forming, the product is placed into these receiving pockets or pouches. A cover is brought to this carrier strip and is sealed to this carrier strip to enclose and encapsulate the product. After this step is completed the carrier strip is preferably further severed at the transverse cuts to provide individual packages.

In the embodiments to be more completely described, there are depicted pouches or pockets as formed in the lower carrier strip. After filling of the pocket or pouch with a product, a cover is sealed in place. The filled and sealed pocket may be further severed from the strip and as individual packages accumulated by methods not shown.

In lower carrier strip is formed a trough while or after transverse cuts have been made. Adjacent to each of the transverse cuts forward and rear end stops are provided and formed in this bottom strip. The product to be packaged is then placed in this trough and between the end stops. A cover member, which may be like formed or may be a film member, is then secured to the sides and ends of the carrier strip to retain the product. The longitudinal sealing may be by heat sealing means or other sealing means. The transverse seal next to the cut may be made in a serpentine manner so that the length of the end seal is the same length as the width of the carrier strip at the cut in the carrier strip before forming into a trough. This serpentine sealing means is usually necessary so that the excess of strip material is sealed without folds or puckers in the carrier strip.

In yet another embodiment the lower carrier strip is formed into a trough with end portions by die means which shapes the lower film while and when the transverse cuts are formed. In the lower strip the desired shape is formed by cooperating die forms. The bottom strip is not stretched since the transverse slits enable the end portions of the container to be moved into a plane that is the same as the side members. The cover may be partly shaped or formed and then sealed to the lower film by upper and lower heated die means. With this alternate embodiment the serpentine seal is not used or required.

The package material may be a foil, paper, a laminate having an interior plastic coating or any other material that is compatible with the product to be packaged. This material is characterized in that said material is capable of retaining its shape once it has been formed. The cover member may be a film and attached to the carrier member as by heat sealing or may be a film or paper member attached as by an adhesive which is preliminarily applied or may be applied just prior to sealing. In each embodiment, to be hereinafter more fully described, it is to be noted that the lower and upper packaging materials, although shaped by dies, fingers and the like, have a transverse slit formed in at least one of the members. The formed slit not only prevents but provides that the packaging materials are not stretched or weakened. Heat and other stretching means commonly used weakens the package particularly at the corners.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen embodiments of a formed pocket of and in a lower carrier strip as adopted for use in packaging foods and the like and showing a preferred means for cutting, forming, filling and sealing the product. These specific embodiments and the apparatus for producing therein have been chosen for the purposes of illustration and description as shown in the accompanying drawings wherein:

BRIEF DESCRIPTION OF THE DRAWINGS

In the following description and in the claims various details are identified by specific means for convenience. These names are intended to be generic in their application. Corresponding reference characters refer to like members throughout the several figures of the drawings.

The drawings accompanying and forming part of this specification disclose details of construction for the purpose of explanation but structural details may be modified without departure from the concept and principles of the invention and the invention may be incorporated in other structural forms than shown.

DETAILED DESCRIPTION OF THE DRAWINGS OF FIGS. 1 THROUGH 4

Figures 1, 2, 3, 4, 12:
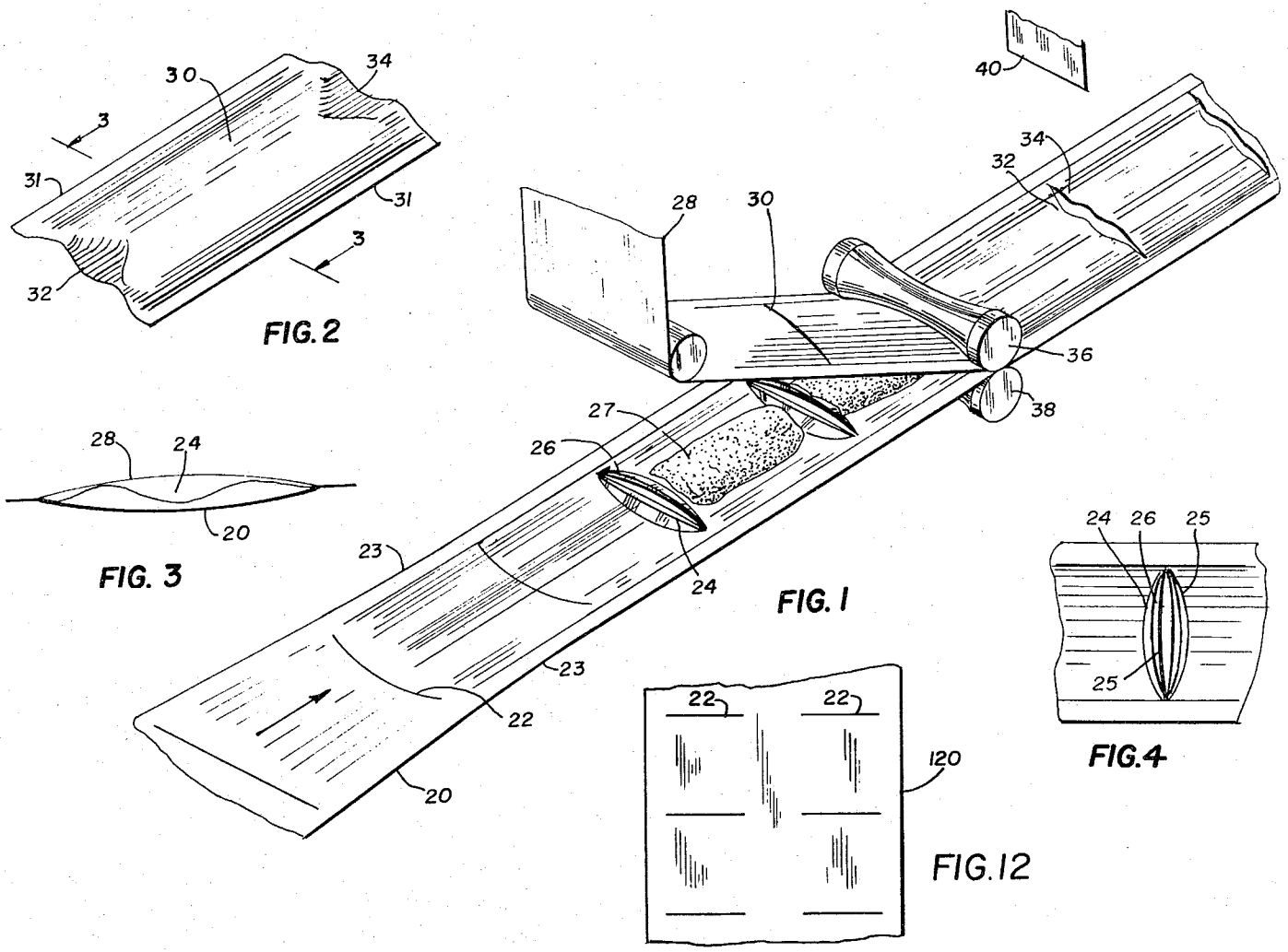
FIG. 1 represents an isometric, partly diagrammatic view showing the apparatus for forming of the package in which the bottom strip member is formed into a trough with the ends formed into stop members adjacent a transverse cut in the carrier strip.
FIG. 2 represents an isometric view in an enlarged scale and an individual packaged product as produced by the operation and apparatus of FIG. 1.
FIG. 3 represents a sectional view of the package of FIG. 2, this sectional view taken on the line 3—3 of FIG. 2 and looking in the direction of the arrows.
FIG. 4 represents a plan view partly fragmentary and showing the transverse cut as and after the adjacent end portions have been formed in the carrier strip.
FIG. 12 represents a fragmentary plan view showing the bottom strip cut for plural pockets.
Figure 8:
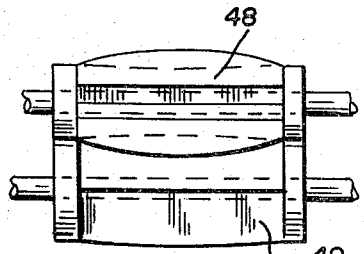
FIG. 8 represents a transverse view and showing mating rollers adapted for forming end stops in the lower member, this view taken on the line 8—8 of FIG. 5 and looking in the direction of the arrows.

Referring now to the package as provided by the apparatus as suggested in FIGS. 1 through 4, it is to be noted that the apparatus above has a carrier strip 20 cut at predetermined intervals to form transverse cuts 22. These cuts do not extend completely across this strip but stop an appreciable and determined distance from the edges 23. This travelling strip is delivered from a roll stand, not shown, and as it is advanced is moved between upper and lower rollers, not shown, to form a trough in this strip. This trough may also be formed with shoes or fingers over and under which the strip may be moved. Both means are well known in the industry and hence are not illustrated. Forming a trough results in the edges moving inwardly toward one another. After forming the trough, end portions or stops 24 are formed by die means, not shown. Forming dies or shoes, also well known and illustrated in the prior art, can be by protrusions and recesses in mating rollers. Forming may also be by reciprocating dies either mechanically or hydraulically moved in timed relationships with the movement of the film. When these end portions are formed, the cut 22 is as seen in FIG. 4. As and when the plane or surface 24 extends upwardly from the trough portion it causes the cut to spread at its center to a shape corresponding to interconnected arcs 25. The end portions 24 are formed to provide short planar areas next to each cut. These are short or small areas between the cut and the end portions which are identified as 26. The product 27 is now placed in the trough area and between the formed ends 24. A top cover 28 is now brought to and toward the formed lower troughed strip. This cover may be curved to provide a pouch or pocket, as seen in FIG. 3. This material of strip 20 has sufficient memory so that after forming and shaping said material is capable of retaining its as formed shape without heating or stretching.

This cover 28 is sealed to the lower member 20 at its edges. A transverse cut 30 may also be formed in the cover and spaced and positioned so as to mate with the lower cut 22 as and when the upper cover 28 is brought into position and affixed to and on the lower carrier 20. A longitudinal seal 31 along each edge is now made. Transverse seals 32 and 34 are now made and are adjacent to each cut. Each transverse seal is serpentine in configuration and accommodates in length the width of the strip at the cut 22 before the carrier strip has been formed into a trough. This serpentine and elongated sealing member is provided so that no folds or puckers occur at the seal of the pocket. It is to be noted that after troughing the lower carrier 20 may be retained in its formed position by means of a vacuum-type belt. Vacuum belts are well known in the art and field and will be used when and where required. The top cover 28 may be a film formed in place and retained by a vacuum belt similar to that provided for the bottom member 20. The product 27 to be packaged may be a liquid, solid, semi-solid, granular or any combination of these and this product is retained in and by the trough area, the end members 24 and the sealed cover 28. It is to be noted that the package 35 shown in a depicted "in-line" sequence is "one up" but multiple packages can be formed in the lower member and cover. Troughing for receiving and retaining the product is also provided. In no case is a deformation or a stretching of material to be contemplated.

An upper contoured roller 36 is depicted as shaping the cover member 28. A lower like contoured roller 38 is adapted to mate with roller 36 and at their outer enlarged diameter portions to press the package edges 31 together. If heat sealing is to be achieved on this package these rollers 36 and 38 may have locally heated portions to provide the desired sealing results. The sealing of the ends 32 and 34 are by sealing means, not shown. Usually a serpentine form is provided on one side of the package (top or bottom) and a supporting means is provided at the opposite side. If a heat seal is to be made, the heated dies may be carried by member 40 for programmed advancement to the package. It is to be noted that the transverse seal is made in that more-or-less planar area 26 between the upturned end stop portions 24 and the cut 22 which results in area 25. Where and when the upper cover 28 is also to be carried, the end stop portions 24 are displaced from the trough so as to extend in a small and shallow arch above the plane of the side portions 31. The extent of this upward arch is merely a matter of selection determined by the package to be made and furnished. The serpentine seal provides the needed length to form a seal without wrinkles.

MECHANICAL APPARATUS AS IN FIGS. 5 THROUGH 11

As seen in FIGS. 5 through 11, the package making as shown and described in FIGS. 1 through 4 is diagrammatically shown as mechanically performed by apparatus such as shown in FIGS. 5 through 11. The representation of this apparatus is only a suggestion of the apparatus that may be used and other apparatus may be presented, as for example the apparatus of FIGS. 13 through 17. As seen in FIGS. 5 through 11, the lower strip 20 is delivered from a roll stand 41. This strip 20 is carried to mating cutting or knife rollers 42 and 43 which are rotated by drive means not shown and said rollers in a timed relationship produce cuts 22 in lower strip 20. The knife rollers 42 and 43 are carried by a support frame 44.

Troughing rollers 45 and 46 are also carried by said frame and are contoured to shape the lower strip 20 in an arcuate configuration. After troughing, the lower carrier strip 20 is now brought in way of mating rollers 48 and 49 which are rotated in a timed relationship with the advancement of the strip 20 so that each cut 22 is entered so that end surfaces or stops 24 are formed so that when spread apart there are also very short top portions or surfaces 26. The lower roller 49 is depicted as having the shape of an equally sided prism on a shaft carried with and by the frame 44. The upper roller 48 is shown as cylindrical with equally spaced, scalloped recesses which are shown as right-angled, inwardly directed relief portions that are shaped to cooperate with the lower roller and upturn the troughed strip in local portions as seen in FIG. 1. Rollers 48 and 49 are turned in a timed relationship to the advancement of the strip 20.

The troughed strip having the end stops 24 shaped and formed is now filled with a desired quantity of product 27. Conventionally, this product is delivered from a hopper 51 through a spout 52. Not shown, but normally provided is a product controlling valve that is actuated to provide a delivery of product in a timed sequence and in a predetermined volume.

At a later stage the upper film strip 28 is delivered from a roll stand 54 to upper and lower sealing rollers 36 and 38 which are journaled and rotated by and with shafts 56 and 57. These rollers may be heated if the films are so constructed. If the sealing is by adhesive the applicator device is disposed before the rollers 36 and 38. Said rollers are usually powered to turn in a timed relationship to the advancement of the package.

Figure 10:
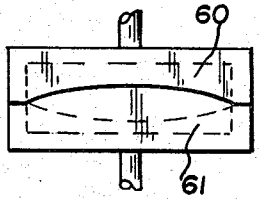
FIG. 10 represents a transverse view and showing reciprocating dies for making the transverse seals of the package, this view taken on the line 10—10 of FIG. 5 and looking in the direction of the arrows.
Figure 6:
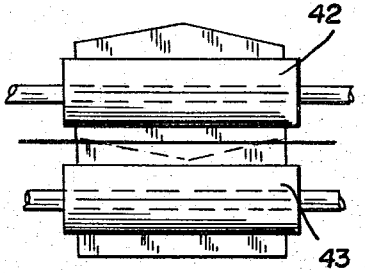
FIG. 6 represents a transverse view taken on the line 6—6 of FIG. 5 and looking in the direction of the arrows and showing roller means for localized cuts in the lower member.
Figure 9:
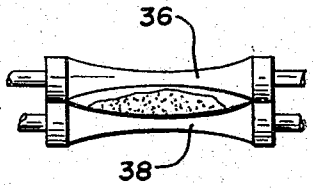
FIG. 9 represents a transverse view and showing mating rollers adapted for securing the longitudinal edges of the cover to the bottom member, this view taken on the line 9—9 of FIG. 5 and looking in the direction of the arrows.

At a still later stage the upper and lower strips 28 and 20 are sealed transversely. In FIG. 10, upper and lower dies 60 and 61 are caused to be brought to a sealing condition and position. When said strips are sealed by and with heat the dies 60 and 61 are heated. When adhesive is used the same adhesive as for longitudinal sealing is applied.

The now sealed package is severed to provide individual packages 64. An upper knife 40 cycled by a piston rod 66 mates with a cooperative knife 68, also cycled as by a rod 69. After severing into individual packages 64, said packages are delivered as by a chute or slide 70.

Plural Package Forming as in FIG. 12

As depicted in FIG. 12, the several concepts also contemplate that a multiple formation of packages may be made in the strip and more than a "one-up" arrangement may be provided. The carrier strip and the corresponding upper web which is brought into place to provide the cover of the product provides a sealed product and package in multiple widths. The resulting strip of packages is severed and trimmed so that the packages are provided in the manner described. Whether a single slit or multiples thereof are utilized, the package material forming the pouch is not stretched or heated. A vacuum table may be provided if necessary to hold the trough material in the desired shape while filling. A covering may now be provided. The pocket has its width and depth dimensions formed to accommodate the product to be positioned or placed in this pouch whether a liquid, solid, semisolid or granular. An adhesive may be used to hold the cover to the pocket whereat a hot seal bar is not required. Severing of the strip may be as in FIG. 11 and is at the convenience of the package machine operator.

Alternate Embodiment of FIGS. 13 through 17

Referring next and finally to FIGS. 13 through 17, there is shown an alternate arrangement to the package as produced by the apparatus of FIGS. 1 through 4. In this alternate embodiment of FIGS. 13 through 17 the lower film is shaped by die means, to be hereinafter more fully described. The cover can also be shaped by similar means with sealing preferably by heated dies.

Figures 13, 14, 15, 16, 17:
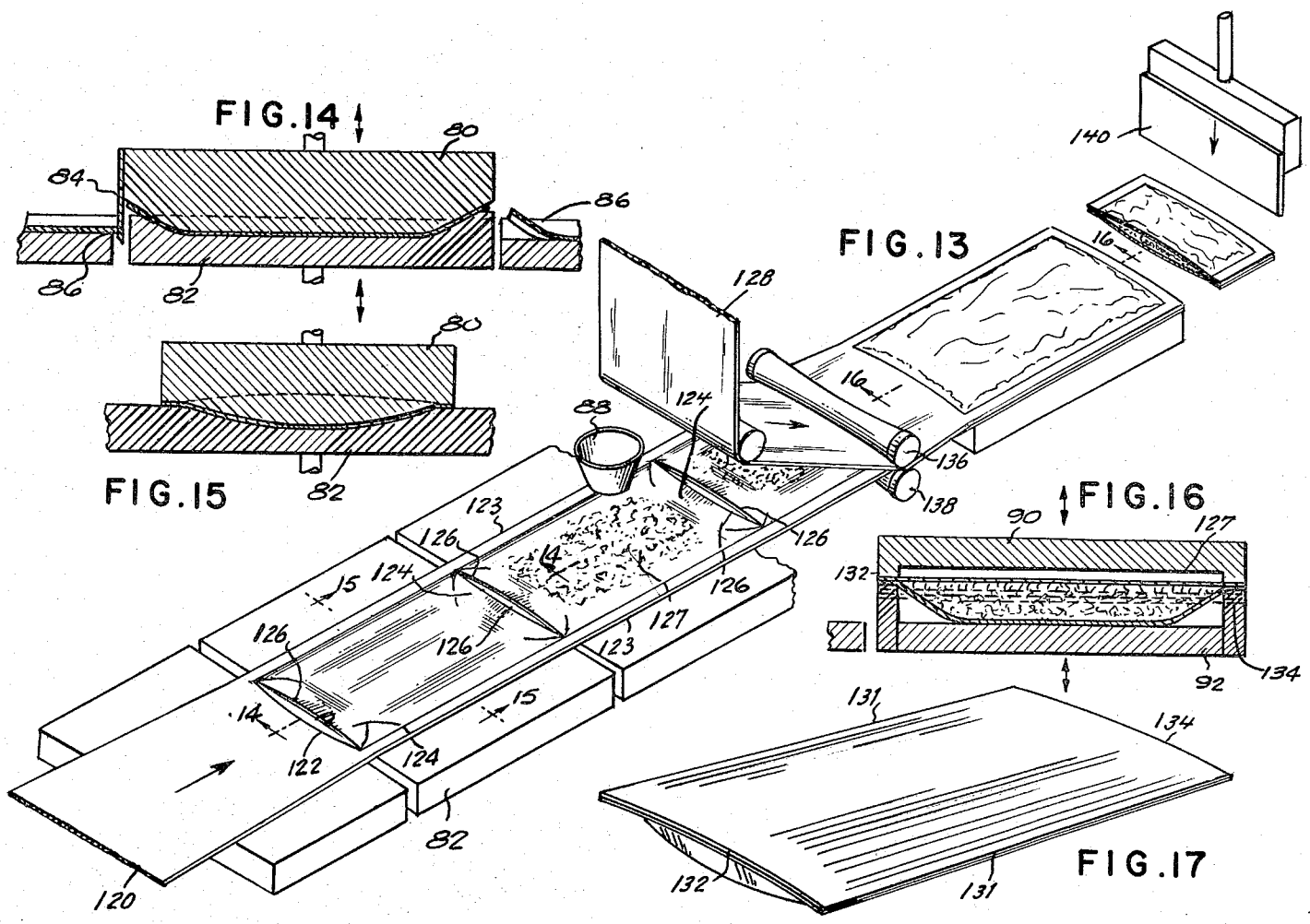
FIG. 13 represents an isometric, partly diagrammatic view, of an apparatus similar to FIG. 1 and showing an alternate forming of a package in which the bottom member is formed by die means into a trough and with ends in a planar arrangement and with the transverse cut simultaneously made in the carrier strip.
FIG. 14 represents a side, sectional view in a partially enlarged scale, this view taken along the line 14—14 of FIG. 13 and looking in the direction of the arrows.
FIG. 15 represents a sectional view of the die and lower film of FIG. 14, this view taken along the line 15—15 of FIG. 13 and looking in the direction of the arrows.
FIG. 16 represents a sectional view of a heat sealing die means for sealing the package as produced by the apparatus of FIG. 13, this view taken on the line 16—16 and looking in the direction of the arrows.
FIG. 17 represents an isometric view of a completed package as produced by the apparatus of FIG. 13.

As shown, a lower carrier strip 120 is cut at predetermined intervals to form transversing cuts or slits 122. These cuts, like the cuts above described, do not extend completely across the carrier strip but stop an appreciable and determined distance from the edges 123. This travelling strip is delivered from a roll supply, such as roll stand 41 as in FIG. 5. In its advance the lower carrier strip 120 is brought to and between upper and lower die forms 80 and 82. As depicted in FIG. 14, the upper die form is of male configuration and has a protruding central portion which forms the pouch or cavity in this lower carrier. A like and mating configuration is formed in the lower die 82 allowing, of course, for the thickness of the carrier strip. As indicated by the arrows, the upper and lower die forms 80 and 82 are reciprocated toward and away from each other by hydraulic cylinders having piston rods 81 A and 81 B.

As shown, the transverse cut or slit 122 is made by knife means 84 which is carried by and is moved with the upper die 80. Said knife 84 enters cutout 86 formed in or provided in the lower die form 82. As shown in FIG. 13, the lower die forms a support for the lower carrier strip 120 and as a portion of and adjacent the fixed table 87 provides for the formation of the pouch or pocket. Said lower die form 82 is cycled up and down during the advance of the lower carrier strip. The mating die form cause end stops 124 to be formed at both ends of the pocket. These end stops are substantially in the same plane as the side portions 123 but as in FIG. 1 the central portions are displaced above the outer side portions. The forming of the carrier into a pouch or pocket causes the strip at the cut to gap or pull slightly apart at 126. The end portions 124, next to the cuts 122, are urged upwardly by the dies to provide the configuration much like that in FIG. 14. A top cover 128 is now brought to and toward the lower shaped carrier strip 120. This cover may be curved to provide a pocket or pouch as seen in FIGS. 16 and 17.

Figure 11:
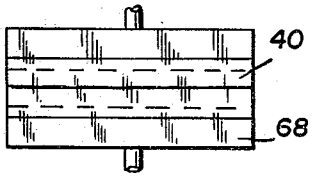
FIG. 11 represents a transverse view and showing the reciprocating knives for cutting the packages into separate components, this view taken on the line 11—11 of FIG. 5 and looking in the direction of the arrows.
Figure 5:
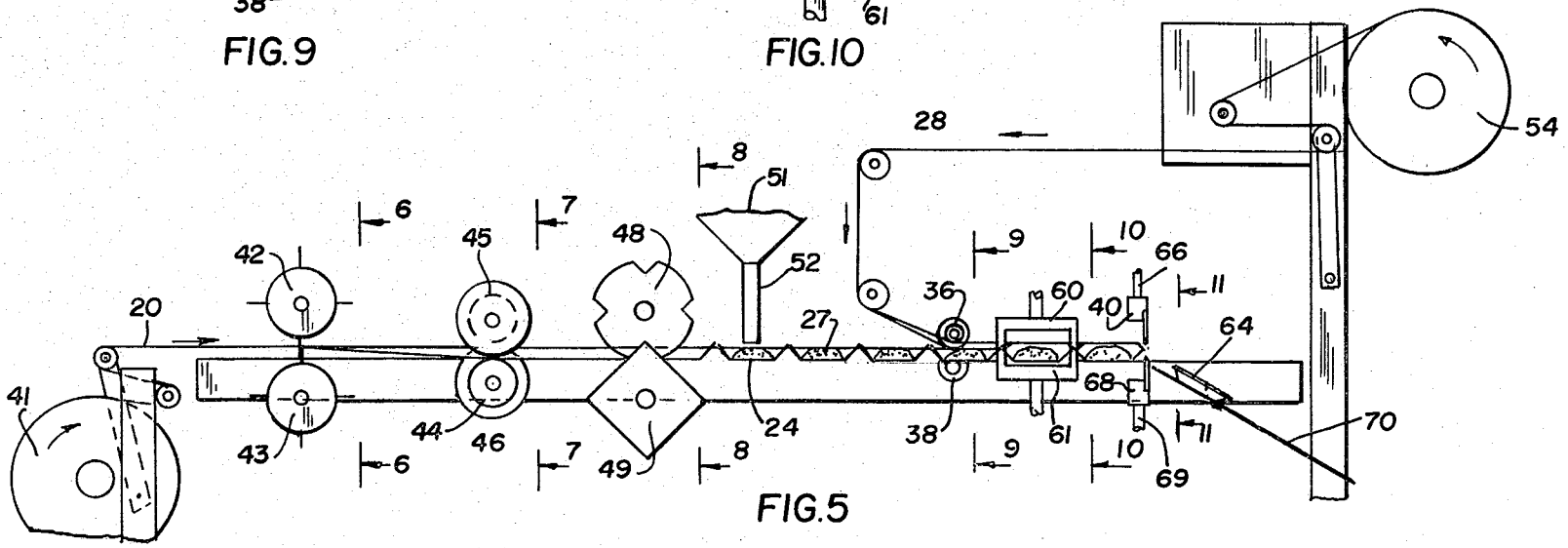
FIG. 5 represents a side view, partly diagrammatic, of apparatus that may be used to provide the progressive steps of forming and sealing the package of FIG. 1.
Figure 7:
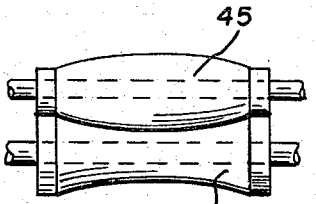
FIG. 7 represents a transverse view and showing mating troughing rollers for shaping the lower member, this view taken on the line 7—7 of FIG. 5 and looking in the direction of the arrows.

The cover 128 is brought to the formed lower pocket after filling with a product 127 as delivered by and through a spout or funnel member 88. This spout and supply hopper is similar to or identical to that shown in FIG. 5. As depicted, side sealing 131 of the cover to the lower carrier is initially provided by upper and lower rollers 136 and 138. After an initial side seal is provided transverse seals 132 and 134 may be made by mating heated dies 90 and 92 which are cycled toward and to each other by hydraulic or similar means not shown. The transverse seals 132 and 134 are shown in FIG. 16 and the arrows suggest the cycled motion used to move the dies 90 and 92 to and from a sealing position and pressure. A completed package is shown in FIG. 17 and the cutting into separate packages is suggested by a knife 140 shown in FIG. 13. The cutting of the packages into individual members is shown in FIGS. 5 and 11 above. If heat sealing is to be utilized the rollers 136 and 138 and the dies 90 and 92 are also to be heated. This is not to preclude the use of foil and an adhesive or other known sealing means.

In the above examples of forming a trough or pouch in the lower web, it is noted that this troughing or forming does not stretch or weaken the carrier. The troughing and/or forming causes a diminishing of the width of the package. The edges and those transverse portions next to the cut are maintained substantially so that a seal can be easily and readily made by heat and/or pressure so that the filled packages may be carried through the apparatus by standard drive or advancing mechanism.

In the pouch formed by the apparatus of FIG. 1, it is to be noted that the lower cuts 22 and the upper cuts 30 (when provided) are usually made by reciprocating knives but this does not preclude other means such as knives carried in and by roller means. The end stops 24 are conventionally formed by mating reciprocating dies but also may be formed by rotary shaping means such as fingers.

It is realized that structure in FIG. 1 has not shown the transverse slitting and the troughing. The transverse sealing also has not been shown. This apparatus is conventional and may be made in many ways. The structure shown in FIG. 13 is merely representative of means for achieving this slitting, shaping, folding and sealing of a particular product. The package and the material to be used are considerations to be evaluated by the designer of the apparatus.

As a method the above apparatus provides the steps of: providing and advancing a lower member of determined width and of a long length sheet material adapted to form a series of receiving pockets; forming a series of substantially identical transverse cuts in said lower member and at substantially equal and regular intervals, these cuts less than the width of the lower member therewith and thereby leaving side carrier portions in the lower member; troughing said lower member, said trough extending substantially the same width in the lower member as the transverse cut; forming an end stop on each side of each transverse cut and with these stops and the trough providing a product receiving pocket, said end stops being formed in the lower member absent heat and stretching of said member so that the integrity of all wall portions of the pocket remain substantially unchanged in their travel through the forming steps, delivering a desired quantity of product to and into the formed pocket of the lower carrier; attaching a cover to the rim portions around the pocket to retain the product in said pocket, and subsequently severing the sealed pockets into separate packages. The above method also provides additional steps as in the claims.

Terms such as "left", "right", "up", "down", "bottom", "top", "front", "back", "in", "out" and the like are applicable to the embodiments shown and described in conjunction with the drawings. These terms are merely for the purposes of description and do not necessarily apply to the position in which the pouch or pocket in the carrier web may be constructed or used.

While particular embodiments of the package formed in the carrier strip have been shown and described it is to be understood that the carrier strip members may be disposed at any angle from horizontal to vertical and the invention is not limited by this disclosure since modifications may be made within the scope of the accompanying claims and protection is sought to the broadest extent the prior art allows.

What is claimed is:

1. Apparatus for the in-line production of a package for a product which may be granular, solid, semisolid, liquid and/or combinations thereof, said produced package including a lower member of material being capable of retaining its shape once it has been formed and a cover member, said members having facing surfaces adapted for sealing one to the other, said apparatus including:

(a) means for feeding and supporting a lower member of determined width and of a long length of sheet material;

(b) means for forming a plurality of substantially transverse cuts in said lower member and at substantially equal and regular intervals, these cuts being less than the width of the lower member thereby leaving side carrier portions on the lower member;

(c) means for forming a trough in said lower member, said trough having substantially the same surface width in the lower member as the length of said transverse cuts;

(d) die shaping means for forming an end stop on each side of each transverse cut and with these end stops and the trough providing a product receiving pocket, said end stops being formed in the lower member absent heat and stretching of said member so that the integrity of all wall portions of the pocket remain substantially unchanged in their travel through the apparatus;

(e) means to feed a desired quantity of product to and into the formed pocket of the lower carrier;

(f) means for attaching a cover member to the rim portions around the pocket to retain the product in the pocket, and (g) means for severing the sealed pockets into separate packages.

2. Apparatus for the in-line production of a package for a product as in claim 1 in which the lower member is made sufficiently wide so that side-by-side transverse cuts may be formed in the lower member and with correspondingly formed troughs and end stops for the plural forming and filling of the pockets.

3. Apparatus for the in-line production of a package for a product as in claim 1 in which the cut in the lower member is substantially a single straight line and the formed trough is arcurate in shape.

4. Apparatus for the in-line production of a package for a product as in claim 3 in which the end stops are pushed upwardly from the trough to at least the plane of the side carrier portions of the lower member.

5. Apparatus for the in-line production of a package for a product as in claim 3 in which the end stops are pushed upwardly from the trough to extend above the plane of the side carrier portions of the lower member and with the cover formed to accommodate the upward projection of the end stops.

6. Apparatus for the in-line production of a package for a product as in claim 5 in which the cover member is additionally cut at the same spacing and width extent as those cuts made in the lower member.

7. Apparatus for the in-line production of a package for a product as in claim 6 in which the seal means for the package portion adjacent the transverse cut in the lower member is made of a length equal to the length of the cut before shortening by trough forming.

8. Apparatus for the in-line production of a package for a product as in claim 7 in which the transverse seal bars are formed with serpentine configurations.

9. Apparatus for the in-line production of a package for a product as in claim 1 in which the lower member is formed into a pocket by cooperating die forms moving to and toward one another to form the lower carrier strip into a pocket with a planar border arrangement of the edge and transverse portions, and after forming the pocket the die forms are moved from each other to allow the now formed lower carrier to be moved from in way of the dies.

10. Apparatus for the in-line production of a package for a product as in claim 9 in which the transverse intermediate cuts in the lower member is produced by knives carried in and by the upper die form.

11. Apparatus for the in-line production of a package for a product as in claim 9 in which the transverse seals are made by reciprocable die forms moved toward and to the upper and lower films after filling of the pocket, and after sealing the pocket the die forms are moved from each other and away from the now packaged product.

12. Apparatus for the in-line production of a package for a product as in claim 11 in which the films are made of heat sealable material and the sealing dies are heated.

13. A method for forming a package for a product which may be granular, solid, semisolid, liquid and/or a combination thereof, said package including a lower member and a cover member of material being capable of retaining its shape once it has been formed, said members having facing surfaces adapted for sealing one to the other, the steps of forming said packages including:

(a) providing and advancing a lower member of determined width and of a long length of sheet material adapted to form a series of receiving pockets;

(b) forming a series of substantially identical transverse cuts in said lower member and at substantially equal and regular intervals, these cuts less than the width of the lower member thereby leaving side carrier portions in the lower member;

(c) troughing said lower member, said trough extending substantially the same surface width in the lower member as the transverse cut;

(d) forming an end stop at and on each side of each transverse cut and with these stops and trough providing a product receiving pocket, said end stops being formed in the lower member absent heat and stretching of said member so that the integrity of all wall portions of the pocket remain substantially unchanged in their travel through the forming steps;

(e) delivering a desired quantity of product to and into the formed pocket of the lower carrier;

(f) attaching a cover to the rim portion around the pocket to retain the product in said pocket, and (g) subsequently severing the sealed pockets into separate packages.

14. A method for providing a package for a product as in claim 13 which further includes forming each cut in the lower member in a substantially single straight line and forming a trough in an arcuate shape.

15. A method for providing a package for a product as in claim 13 which further includes forming the end stops so that they are pushed upwardly from the trough to at least the plane of the side carrier portions of the lower member.

16. A method for providing a package for a product as in claim 13 which further includes forming the end stops so that they are pushed upwardly from the trough and extend above the plane of the side carrier portions of the lower member and forming the cover to accommodate this upward projection of the end stops.

17. A method for providing a package for a product as in claim 13 which further includes forming the seal for the package portion adajcent the transverse cut in the lower member of a means having a length equal to the length of the cut before shortening by trough forming.

18. A method for providing a package for a product as in claim 13 which further includes forming the pocket in the lower member by cooperating die forms moving to and toward each other to provide a pocket in the lower strip, the forming of this pocket providing a planar border of the edge and transverse portions and after forming the pocket moving the die forms from in way of the pocket.

19. A method for providing a package for a product as in claim 18 which further includes cutting the transverse slits intermediate the side edges by knives carried in an by the upper die forms.

20. A method for providing a package for a product as in claim 18 which further includes forming the transverse seals by upper and lower dies and moving said dies to and toward each other after filling of the pouch, and after sealing moving the sealing dies from each other and away from the now packaged product.

21. A method for providing a package for a product as in claim 20 which further includes using heat sealable films and forming the seals by heated dies.

* * * * *